US005297970A

United States Patent [19]

Carney

[11] Patent Number: 5,297,970

[45] Date of Patent: Mar. 29, 1994

[54] CONNECTOR BLOCK AND CONNECTOR BLOCK ASSEMBLY WITH OFFSET CONTACTS

[75] Inventor: William V. Carney, Oyster Bay, N.Y.

[73] Assignee: Porta Systems Corp., Syosset, N.Y.

[21] Appl. No.: 16,460

[22] Filed: Feb. 11, 1993

[51] Int. Cl.[5] ..... H01R 13/658

[52] U.S. Cl. ..... 439/108; 439/608; 439/682

[58] Field of Search ..... 439/101, 108, 608, 717, 439/79, 682, 692

[56] References Cited

U.S. PATENT DOCUMENTS

| | | | |
|---|---|---|---|
| 3,399,372 | 8/1968 | Uberbacher | 439/101 |
| 3,493,916 | 2/1970 | Hansen | 439/79 |
| 3,517,803 | 6/1970 | Frompovicz et al. | 439/78 |
| 4,004,845 | 1/1977 | Sochor | 439/682 |
| 4,295,703 | 10/1981 | Osborne | 439/404 |
| 4,636,020 | 1/1987 | Marmillion | 439/595 |
| 4,693,532 | 9/1987 | Colleran et al. | 439/717 |
| 5,160,273 | 11/1992 | Carney | 439/108 |
| 5,205,762 | 4/1993 | Carney | 439/607 |

FOREIGN PATENT DOCUMENTS

| | | | |
|---|---|---|---|
| 268441 | 5/1988 | European Pat. Off. | 439/108 |

*Primary Examiner*—Gary F. Paumen

*Attorney, Agent, or Firm*—Fitzpatrick, Cella, Harper & Scinto

[57] ABSTRACT

An elongated electrically insulative connector block (12) contains internal spring finger electrical conductors 78 arranged in sets in adjacent cells ($C_1$, $C_2$, ... $C_n$) which are arranged in a line, with adjacent cells being mutually offset in a direction transverse to the line; and a connector with a plurality of insert elements lying in parallel planes which are mutually offset so that each element can be inserted into adjacent cells.

5 Claims, 4 Drawing Sheets $C_N$
$C_{N-1}$
$C_{N-2}$
$C_{N-3}$
O
$C_4$
$C_3$
$C_2$
$C_1$
(d)
L
12
14
16
10
18
20
22
24
26
28
30
32
A

CONNECTOR BLOCK AND CONNECTOR BLOCK ASSEMBLY WITH OFFSET CONTACTS

BACKGROUND OF THE INVENTION

1. Field of the Invention

This invention relates to connector blocks and connector block assemblies in which connections are made between large numbers of wires. More particularly the invention concerns novel connectors blocks and connector block assemblies which minimize the possibility of signal interference or crosstalk between adjacent connections.

2. Description of the Prior Art

U.S. patent application Ser. No. 07/719,939 filed Jun. 24, 1991 entitled Connector Block Assembly and assigned to the assignee of the present invention discloses and claims a novel elongated connector block which contains closely spaced electrical connectors. These connectors, which are distributed along the length of the block, carry different electrical signals. In order to reduce mutual electrical interference or crosstalk between the adjacent closely spaced connectors, electrically conductive shields are interposed between adjacent connectors.

U.S. Pat. No. 5,205,762 issued Apr. 27, 1993 entitled High Frequency Patch Cord Data Connector, also assigned to the assignee of the present invention, discloses a connector block assembly with sets of connectors. The conductors of each set have spring fingers which contact each other. These spring fingers are parted by the insertion of a card like element into the block. When this occurs, the separated spring fingers carry different signals; and to minimize crosstalk between the separated fingers, the insert is provided with grounded electrically conductive lands and laminations which shield the adjacent spring fingers from each other.

Both of the above described inventions enable connectors to be closely spaced to each other so that high density electrical wiring can be achieved in a small amount of space with a minimum of crosstalk.

U.S. Pat. No. 4,295,703 discloses a connector block in which connectors are distributed along the length of the block with each connector extending transversely of the block. The connectors lie in two planes and are in staggered arrangement. This permits close spacing of the connectors so that a maximum number of connectors can be provided in a given length of the connector block. This patent does not face the problem of crosstalk between adjacent connectors; and the connectors in the two planes substantially overlie each other and are therefor susceptible to crosstalk.

SUMMARY OF THE INVENTION

The present invention provides an additional way to arrange closely spaced electrical connectors with minimum crosstalk. This additional way may be used alone or in conjunction with arrangements of either or both of the above described inventions.

In one aspect, the invention involves a novel connector block of insulative material and formed into a plurality of adjacent hollow cells. Each cell is configured to hold at least one electrical connector therein. The cells are arranged side by side along a longitudinal line with each cell occupying a separate portion of the line. Adjacent cells are displaced from one another in a first direction transversely of the longitudinal line. As a result, electrical connectors in adjacent cells are effectively spaced apart by a greater distance than they would have been if the adjacent cells were not transversely displaced from one another. Because of the greater spacing, the effect of radiation from one connector on an adjacent connector is reduced; and crosstalk between adjacent connectors is minimized.

In another aspect, the present invention involves a novel connector block assembly which comprises an elongated connector block of electrically insulative material and a plurality of electrically conductive connectors positioned within and distributed along the length of the block. Each connector occupies a separate portion of the length of the block and extends in a direction transverse to the length of the block. Adjacent connectors are offset relative to each other in the transverse direction.

As a result, the adjacent electrical connectors are effectively spaced apart by a greater distance than they would have been if they were not transversely displaced from one another. Because of this greater spacing, the effect of radiation from one connector on an adjacent connector is reduced; and crosstalk between adjacent connectors is minimized.

According to a further aspect of the invention there is provided a novel card type connector which comprises a housing and a plurality of flat card insert elements extending outwardly from said housing for making contact with connector elements when inserted into a connector block. Adjacent ones of the insert elements lay in spaced apart parallel planes. This enables the connector to be plugged into a connector block assembly with offset cells. It also increases the spacing between the conductive portions of the different elements and thereby minimizes crosstalk between those elements.

DETAILED DESCRIPTION OF THE PREFERRED EMBODIMENTS

Figure 1:
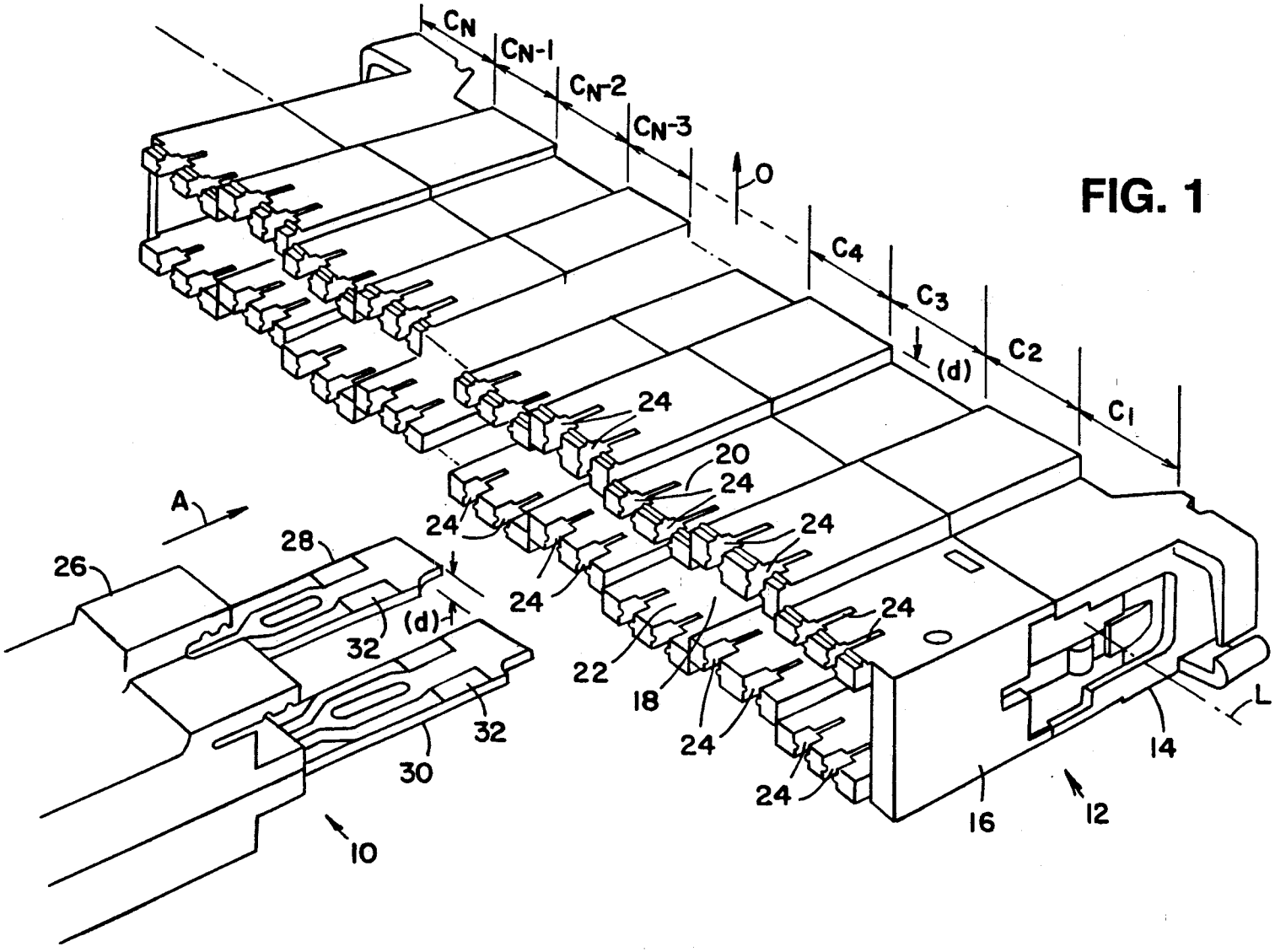
FIG. 1 is a perspective view of a connector block assembly and a printed circuit board connector according to one embodiment of the present invention, with the printed circuit board connector about to be inserted into the block assembly.

As shown in FIG. 1, a printed circuit board connector 10 is about to be plugged or inserted into a connector block assembly 12 by movement in the direction of the arrow A.

The connector block assembly 12 is formed of electrically insulative material, such as molded plastic, and is in a generally rectangular overall configuration extending along a longitudinal line L. The block 12 is made up of a rearwardly positioned base portion 14 and a forwardly positioned contact holder portion 16. These portions, when joined together, form a series of adjacent cells, each cell occupying a region $C_1$, $C_2$,...$C_N$. The cells lie side by side along the line L with each cell occupying a separate portion of the line L so that they do not overlap. Alternate cells ($C_1$, $C_3$, etc.) are offset with respect to their adjacent intermediate cells ($C_2$, $C_4$, etc.), by a distance (d)in a direction along a line O which is transverse to the line L.

The front of the contact holder portion 16 is formed with an elongated connector access recess 18 between upper and lower walls 20 and 22. These walls are each formed with wire connecting slots 24 which open out to the forward ends of the walls 20 and 22. As can be seen, there are two slots 24 for each cell ($C_1$, $C_2$, $C_3$, ... $C_N$), in each of the walls 20 and 22. The slots 24 in the walls 20 and 22 form first openings for wire conductors (not shown) to enter the cells and contact connector elements therein. These first openings extend from the cells in the same direction (O) as that in which the adjacent cells are offset from each other; and the openings extend through the walls 20 and 22 to opposite sides of the exterior of the block.

The printed circuit board connector 10 comprises a molded plastic base 26 and a pair of flat card-like printed circuit board inserts 28 and 30 extending outwardly from one end thereof toward the connector block assembly 12. The inserts 28 and 30 have electrically conductive segments 32 on their surfaces; and these segments make contact, in a manner to be described, with spring finger contacts inside the connector block assembly 12 when the printed circuit board connector 10 is plugged into the connector block assembly. The segments 32 are also electrically connected to corresponding wires in a cable (not shown) which extends out from the opposite end of the connector 10.

As can be seen in FIG. 1, the printed circuit board inserts 28 and 30 are spaced apart from each other to align with adjacent cell regions in the connector block 12. The printed circuit board inserts 28 and 30 lay in parallel planes which are spaced apart by the distance (d) to accommodate the above described offset of the cell regions in the connector block assembly.

Figure 2:
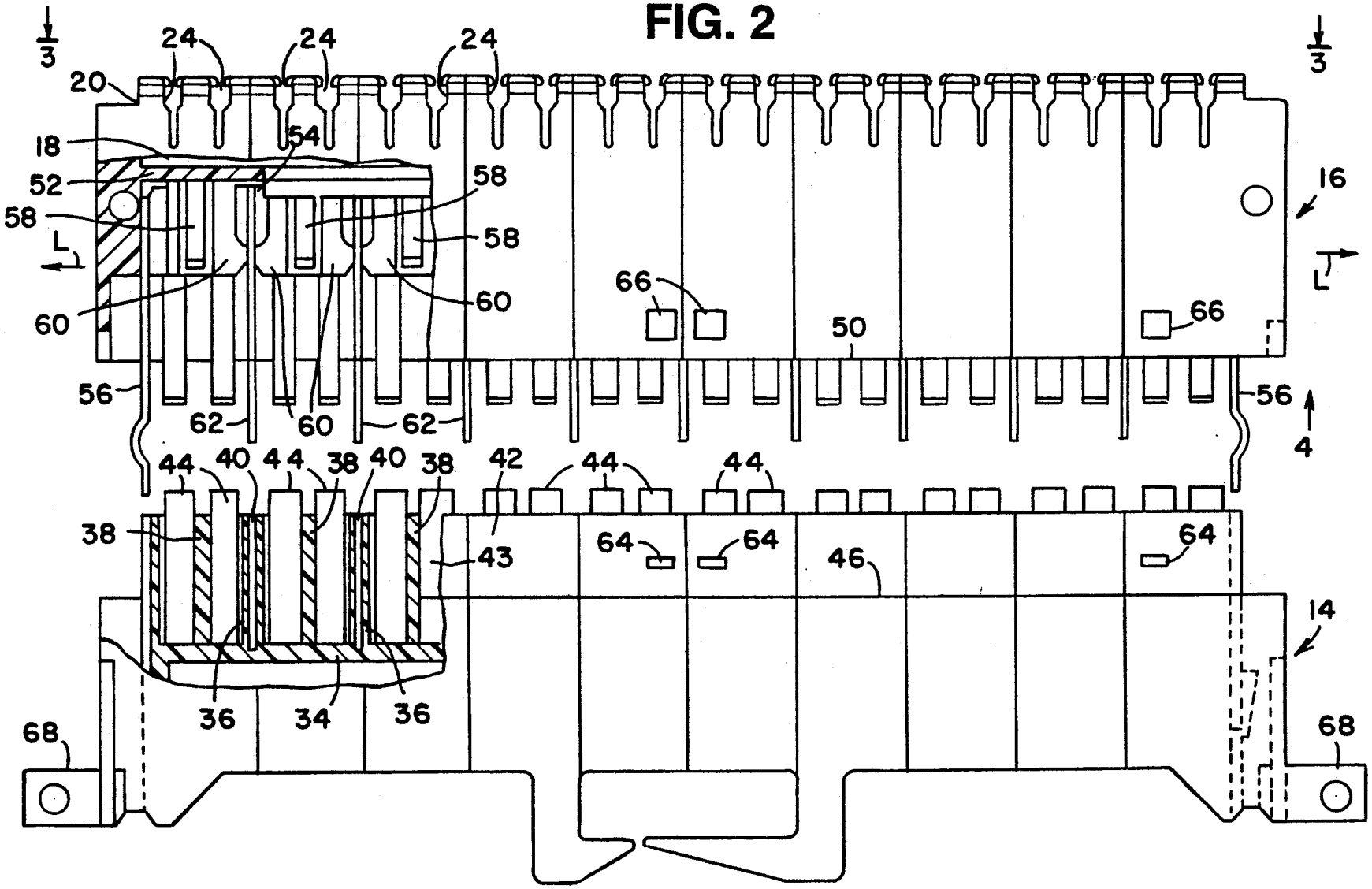
FIG. 2 is an exploded top view of the connector block assembly of FIG. 1, showing a base portion and a contact holder portion separated from each other, with the base and contact holder portions shown as partially cut away.

Turning now to FIG. 2, it will be seen that the base portion 14 is formed with an internal back wall 34 and cell separator walls 36 which extend forwardly (upwardly in FIG. 2) from the back wall 34. Also, the cells themselves are individually divided by internal cell divider walls 38 which also extend forwardly from the back wall 34. The cell separator walls 36 are formed with slots 40 for accommodating shield plates (to be described hereinafter). Between each internal cell divider wall 38 and adjacent cell separator walls 36 are upper and lower outer walls 42 and 43 which extend forwardly beyond the forward edge of the base 14 and form locator tabs 44.

A shoulder 46 is formed along the upper surface of the base 12 and provides an abutment for an edge 48 of a skirt 50 on the contact holder 16.

The contact holder 16 has a front wall 52 which extends along the length of the contact holder between the upper and lower walls 20 and 22 which form the connector base access recess 18. The front wall 52 forms the innermost extent of the recess. Along the inner surface of the front wall 52 is a ground strip 54 of sheet copper or other electrically conductive metal. The ends of the ground strip 54 are formed with end contacts 56 which extend back toward the base 14. The ground strip 54 has spring finger ground contacts 58 bent up from the upper and lower edges thereof in the center of each cell region. In addition contact flanges 60 are bent up from the upper and lower edges of the ground strip 54 at each end of each cell region. These contact flanges abut opposite sides of sheet metal shields 62 which separate the cell regions. As can be seen, the shields 62 extend back from the contact holder 16 and are aligned with the slots 40 in the cell separator walls 36 of the base 14. When the base 14 is fitted to the contact holder 16 the shields 50 extend into the slots 40.

The base 12 is held in assembly with the contact holder 14 by means of projections 64 formed at spaced apart locations along the outer walls 30 of the base in front of the shoulder 32 and corresponding openings 66 in the skirt 50 on the contact holder 14. When the base 14 and contact holder 16 are assembled, the projections 64 extend into the openings 66 to hold the base and contact holder together.

As shown in FIG. 1, cable harnesses 68 are formed at the ends of the base 14 to hold groups of wires (not shown) which extend therefrom to the various wire connecting slots 24. In addition, the ends of the base 14 are formed with supports 70 for the ground strip end contacts 56 when the base and contact holder are assembled.

Figure 3:
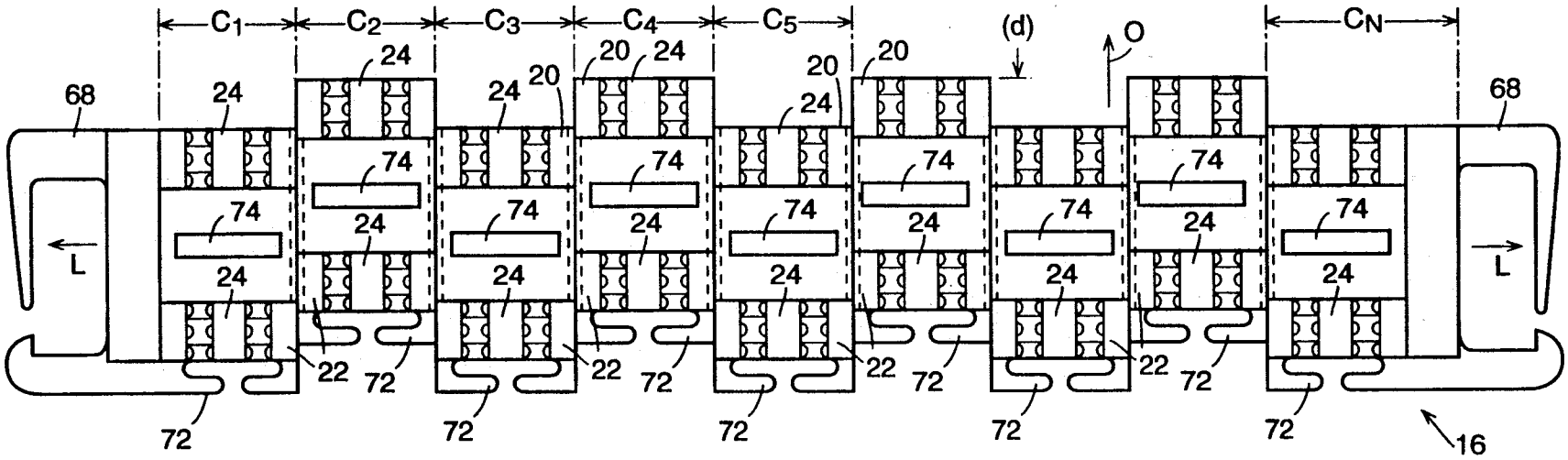
FIG. 3 is a view taken along line 3—3 of FIG. 2.

Turning now to FIG. 3, it will be seen that additional cable guides 72 are formed on the lower surface of the base to hold wires which enter into associated ones of the wire connecting slots 24.

It will also be seen in FIG. 3 that the wire connecting slots 24 are formed in the upper and lower walls 20 and 22 on opposite sides of the connector base access recess 18. FIG. 3 also shows that the walls 20 and 22 and the front wall 52 of the contact holder 16 follow the above described offset arrangement of the cells regions $C_1$, $C_2$, $C_3$ ... $C_N$ in the base and contact holder respectively. Printed circuit insert slots 74 are formed in the front wall 52 in the center of each of the cell regions. These slots form second openings which extend from the cell to the exterior of the block, transversely of the longitudinal line L and transversely of the line O which defines the direction along which the adjacent cells are offset from each other.

Figure 4:
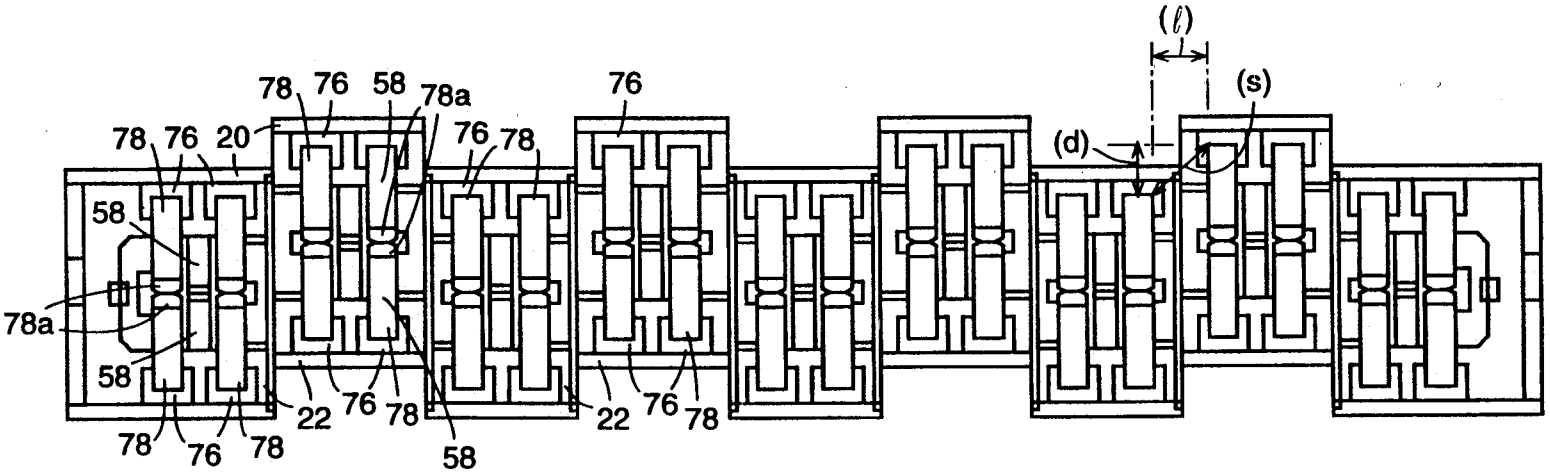
FIG. 4 is a view taken along line 4—4 of FIG. 2.

As shown in FIG. 4, the walls 20 and 22 are formed with spring finger signal contact support sleeves 76 into which one end of spring finger signal contacts 78 extend. Spring finger portions **78*a* of the signal contacts 78 extend out of the sleeves 76 in the wall 20 and press against corresponding spring finger portions 70*a* of signal contacts extending out of the sleeves 76 in the wall 22. Two sets of these spring finger signal contacts are provided in each cell region. It will be appreciated that the spring finger portions 78*a* of opposed signal contacts in each cell region contact each other along a line extending across the center of the cell region; and the two sets of these contacts in each cell region are arranged on opposite sides of the spring finger ground contacts 58 in that cell region. The spring finger ground contacts also are arranged in sets with the contacts of each set touching each other near the center of the cell region. Thus in each cell region there is one set of spring finger ground contacts 58 between two sets of spring finger signal contacts 78**.

Figure 5:
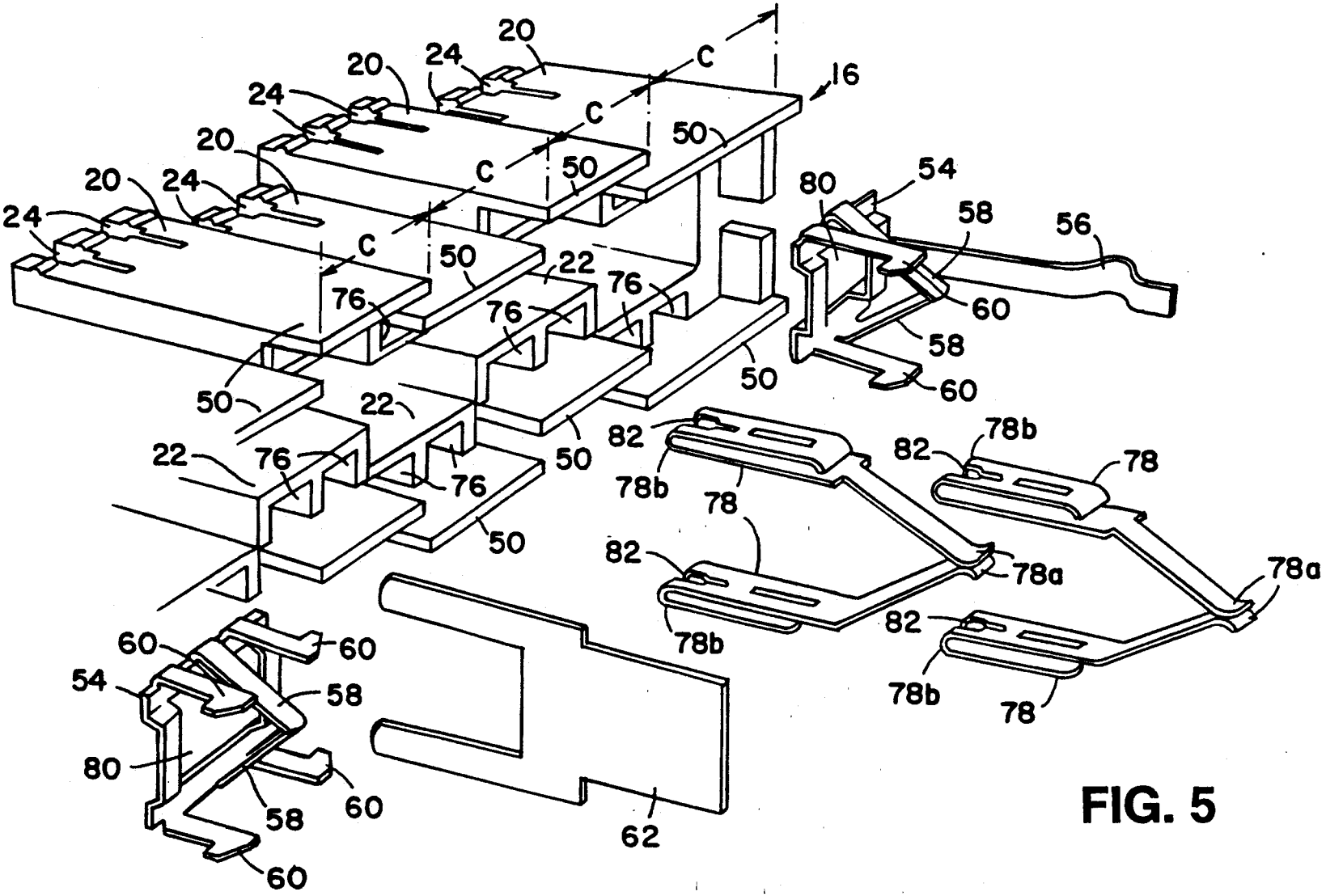
FIG. 5 is a fragmentary perspective view showing the mounting arrangements for connector elements and ground elements in the connector block assembly of FIG. 1.

The configuration and arrangement of the spring finger contacts 58 and 78, the shields 62 and the contact holder 16 are best seen in the exploded perspective view of FIG. 5 which is taken from the back of the contact holder. As can be seen, the skirts 50 form extensions of the outer portions of the walls 20 and 22; and the walls and corresponding skirt portions are divided into offset regions according to the cells $C_1$, $C_2$, $C_3$, ... etc. The outer and inner portions of the walls 20 and 22 cooperate to form the spring finger support sleeves 76, with two such sleeves arranged side by side on the upper side of each cell region and two sleeves arranged side by side in the lower side of each cell region. It will be noted that each sleeve 76 extends up into a region which is bisected by a wire connecting slot 24.

The ground strip 54, as mentioned, is formed from electrically conductive sheet metal such as copper and is bent to form the end contacts 56, the spring finger ground contacts 58 and the contact flanges 60. Also, the central portion of the ground strip 54 is formed to follow the inner surface of the front wall 52 of the contact holder. In addition, the central portion of the ground strip is formed with an opening 80 in each cell to fit around the respective printed circuit insert slots 74 (FIG. 3).

The spring finger signal contacts 78 are formed of electrically conductive sheet metal and are bent to form the spring finger portions 78*a*, which meet in the center of the respective cell regions, and U-shaped base portions 78*b*, which extend into the respective support sleeves 68.

The U-shaped portions contain insulation stripping slots 82 which, when the contacts 78 are inserted into their respective sleeves 76, are aligned with the wire connecting slots 24 of the contact holder 16. Thus when wires are pressed into the slots 24, the slot walls hold the wire by its insulation, but the edges of the insulation stripping slots 82 of the associated spring finger signal contacts 78 cut through the insulation and make positive electrical contact with the contacts themselves. Electrical connection is normally established between wires assembled to the upper side of the block 12 and wires assembled to corresponding locations on the lower side of the block via the normally contacting spring finger portions 78*a* of the signal contacts 78.

As can be seen, the spring finger signal contacts 78 can flex in the direction of the line O.

When the printed circuit board inserts 28 and 30 of a the connector 10 are inserted through the slots 74 (FIG. 3) of the connector block 12 they pass between and separate the normally contacting spring finger portions 78*a*. If the surfaces of the inserts 28 and 30 are insulative, the circuit between the wires in the slots 24 in the upper and lower walls 20 and 22, respectively, is broken. On the other hand, the inserts 28 and 30 may be provided with the electrically conductive segments 32, which will contact the spring finger ends $78_a$; and make connection between the spring fingers 78 and cables (not shown) connected to the connector 10.

Reverting now to FIG. 4, it will be seen that the adjacent spring fingers 78 in adjacent cells are separated longitudinally along the connector block assembly 12 by and amount (1). However, as described above the adjacent cell regions are offset from each other in a transverse direction by an amount (d). Consequently, the true separation (s) between the adjacent spring fingers 78 in adjacent cells is an amount equal to the hypotenuse of a triangle whose sides are (1) and (d). That is, (s) is equal to $\{(1)^2+(d)^2\}^{\frac{1}{2}}$.

By increasing the space between the adjacent spring fingers of adjacent cells (which carry different signals), the amount of coupling between those spring fingers is reduced and the danger of mutual signal interference or crosstalk is also reduced. It will also be appreciated that this reduction did not require any increase in the total length of the connector block assembly. It is accommodated in a small increase in the width or thickness of the assembly.

It will also be appreciated that crosstalk is additionally reduced by means of the shields 62 located between adjacent cells. The manner in which this is accomplished is described in U.S. patent application Ser. No. 07/719,939, filed Jun. 24, 1991 and assigned to the assignee of this application. The way in which crosstalk is reduced according to the present application is not dependent upon the shielding shown in that other application and it can be accomplished without that shielding. However, the two techniques are not mutually exclusive and can be used together for enhanced signal separation or independently as may be desired.

I claim:

1. A connector block formed of insulative material and comprising a plurality of adjacent hollow cells, each configured to hold at least one electrical connector therein, said cells being arranged side by side along a longitudinal line with each cell occupying a separate portion of said line and adjacent cells being displaced from one another in a first direction transversely of said line, each cell being configured to have at least one first opening to the exterior of said block, each said first opening being formed and arranged to accept a wire conductor, said first openings extending in said first direction transversely of said longitudinal line, each cell being further configured with a second opening extending from said cell to the exterior of said block in a second direction transversely of said longitudinal line and transversely of said first direction.

2. A connector block according to claim 1, wherein each cell is configured to have at least two of said first openings extending from within said cell to opposite sides of the exterior of said block.

3. A connector block assembly comprising:

an elongated block of insulative material;

a plurality of electrically conductive connectors positioned within and distributed along the length of said block; each connector occupying a separate portion of the length of said block and extending in a direction transverse to the length of said block;

adjacent ones of said connectors being offset relative to each other in said direction transverse to the length of said block; and electrically conductive shield elements extending transversely across the interior of said block intermediate adjacent mutually transversely offset sets of said connectors.

4. A connector block assembly according to claim 3 wherein each of said connectors is made of flexible electrically conductive material and formed with a spring finger which is normally biased into contact with another element and is flexibly displaceable therefrom in said direction transverse to the length of said block.

5. A connector block assembly according to claim 4, wherein said block is formed with slots for inserting card like insert members into said block to contact said spring fingers.

* * * * *